United States Patent [19]

Katzin

[11] Patent Number: 4,484,352

[45] Date of Patent: Nov. 20, 1984

[54] RECLOSABLE PLASTIC BAG

[76] Inventor: Lawrence F. Katzin, 324 Westridge Dr., Raleigh, N.C. 27609

[21] Appl. No.: 464,322

[22] Filed: Feb. 7, 1983

[51] Int. Cl.[3] ..... B65D 33/24

[52] U.S. Cl. ..... 383/65

[58] Field of Search ..... 383/63, 65; 24/30.5 P

[56] References Cited

U.S. PATENT DOCUMENTS

| | | | |
|---|---|---|---|
| Re. 28,969 | 9/1976 | Naito | 383/65 |
| 3,338,284 | 8/1967 | Ausnit | 383/65 |
| 3,338,285 | 8/1967 | Jaster | 383/65 |
| 3,347,298 | 10/1967 | Ausnit et al. | 383/65 |
| 3,416,585 | 12/1968 | Staller | 383/65 |
| 3,532,571 | 10/1970 | Ausnit | 383/65 |

FOREIGN PATENT DOCUMENTS

| | | | |
|---|---|---|---|
| 103380 | 12/1965 | Denmark | 383/65 |

*Primary Examiner*—Steven M. Pollard
*Assistant Examiner*—David Voorhees
*Attorney, Agent, or Firm*—B. B. Olive

[57] ABSTRACT

An improved, releasable fastener having molded interlocking male and female elements suitable for plastic bag closures, and the like, incorporates ramp surfaces in operative association with one of the elements, typically the female element, to facilitate alignment and closure.

16 Claims, 8 Drawing Figures

RECLOSABLE PLASTIC BAG

TECHNICAL FIELD

The invention relates to separable fastener constructions typically applied as separable closures for plastic bags, and the like.

BACKGROUND ART

Plastic bags used as freezer bags, lunch bags, and storage bags of general utility are often provided with some type of separable fastener formed as molded, interlocking male and female rib and groove elements. U.S. Pat. Nos. 3,338,284; 3,347,298; and Re 28,969 are considered as being representative of the more advanced type of separable fasteners to which the invention relates. For comparison, U.S. Pat. No. 1,959,318 illustrates an earlier construction and also indicates how the art has advanced with improved constructions over the years.

As currently constructed separable fasteners of the type to which the invention relates have two interlocking closure profiles, e.g., rib and groove closure elements formed as protrusions on opposing inner surfaces of the sheet material to be coupled. The closure elements are typically located below or inwardly from the mouth or so-called "flange" portions of the bag. The flanges are gripped to facilitate opening and closing. In order to close a bag having a releasable fastener of this type, the user must first precisely align the two opposing closure elements and then apply pressure along their respective lengths thus forcing the closure elements to engage each other in an interlocking manner. As technology advanced, these closure elements have become increasingly smaller. Accordingly, it has become more difficult for users to manipulate these closure elements into proper alignment.

Throughout the history of the prior art, only the most limited means have been provided to aid the user in placing these closure elements into proper alignment. Currently, except for use of color coding as exemplified in U.S. Pat. No. 4,186,786, no means so far as is known have been provided along the length of the closure elements to facilitate the alignment and subsequent closing operation. U.S. Pat. No. 3,347,298 is noted as teaching a flexible wedge adjacent one side of the groove element. However, such wedge acts as a force-distributing device and is not taught as being useful as a ramp surface. Such aligning aids as are known to exist are provided in the form of localized starting points which are found only at the extreme ends of the closure elements. At these points where the opposing bag walls come together, two unique areas are formed in which the opposing closure elements reside in close proximity to each other. As a result of this close proximity, there exists within these two small areas a natural tendency for the opposing closure elements to be urged into proper alignment. Unfortunately, because these starting areas are so small, many people have difficulty in using them as convenient aids in the proper aligning and subsequent interlocking of the closure elements.

With the foregoing background art in mind, it would be desirable to provide an improved separable fastener construction in which the closure profiles would lend themselves by the manner in which they are formed to ease of alignment and ease of closure. Thus, the obtaining of an improved separable fastener for plastic bags, and the like, becomes the primary object of the present invention. This and other objects will become more apparent as the description proceeds.

DISCLOSURE OF INVENTION

An interlocking rib-groove element construction is used as an example and is shown modified according to the invention such that the groove or female element is formed between a pair of ramp surfaces. The ramp surfaces thus provide smooth, inclined, planar surfaces on which the leading part of the rib or male element can slide from one side or the other of the groove element and effectively find and locate itself into the groove element by sliding over a ramp surface.

The ramp-like surfaces in the improved construction of the invention permit the user to slide the leading part of the male closure element against the opposing bag or flange surface from which surface the male element may then easily slide across the adjoining ramp-like surface in a direction toward the female closure element and then align itself and be seated in the female or groove element. The ramp-like surfaces of the invention may be used in a variety of configurations wherein such variables as thickness, how the ramps are secured to other bag structures, location of the closure means, the degree and direction of inclination and type of materials used may each be chosen at will in order to produce such embodiments of the invention as may be required to function with various systems of closure elements or profiles. The elements themselves may be formed by extrusion, plastic welding or any other plastic technique suited to the invention and may be of the same or a material different from that used to form the ramp structures of the invention. The ramp-profile structures of the invention thus also exhibit the advantage of being able to adapt the invention to those bag constructions in which it is intended that there be a difference in the ease with which the bag is opened either from the outside or inside and when filled or unfilled.

While all of the illustrated embodiments used by way of example are directed to a single rib element mating with a single groove element, it is recognized that the invention nevertheless lends itself to use with other types of bag closure profiles as, for example, where multiple rib elements mate with multiple groove elements. In such applications, the ramp structures of the invention would appear on the outermost sides of the outermost groove elements. Those skilled in the art will also recognize that closure profiles, other than the rib and groove type used by way of example, such as the channel-like profiles seen in U.S. Pat. No. 4,212,337 or other profiles known to those skilled in the art to be adaptable to the ramp structures of the invention, could also enjoy the benefits of the invention.

In another illustrated embodiment, ramps are provided adjacent and sufficiently spaced from a rib element such that the groove element can effectively slide on ramp surfaces on either side of the rib element. In a still further embodiment, ramps are provided on opposite sides of the groove element and each ramp provides two surfaces which are angled with respect to each other between the mouth of the groove element and the wall from which the ramps extend. In a broad sense, the invention is thus directed to providing ramp surfaces on opposite sides of at least one of the interlocking elements, whether male or female and normally the female, to facilitate the other element sliding into engagement with the element having the ramps.

In those instances where the female closure element is formed as an inward protrusion from the surface or bag wall, the ramps will be inclined inwardly, as in FIG. 2, from the inner surface of the bag wall to the mouth of the female or groove element. However, in those instances where the female closure element protrudes outwardly from the inner surface of the bag wall, the ramp surfaces of the invention are also inclined outwardly from the inner surface of the bag wall to the mouth of the female element as in FIG. 6.

As will become clear from the following description and drawings, the invention in the most literal sense provides a new approach to the problem of properly aligning and subsequently interlocking plastic bags having sliderless interlocking closure elements.

BEST MODE FOR CARRYING OUT THE INVENTION

Figure 1:
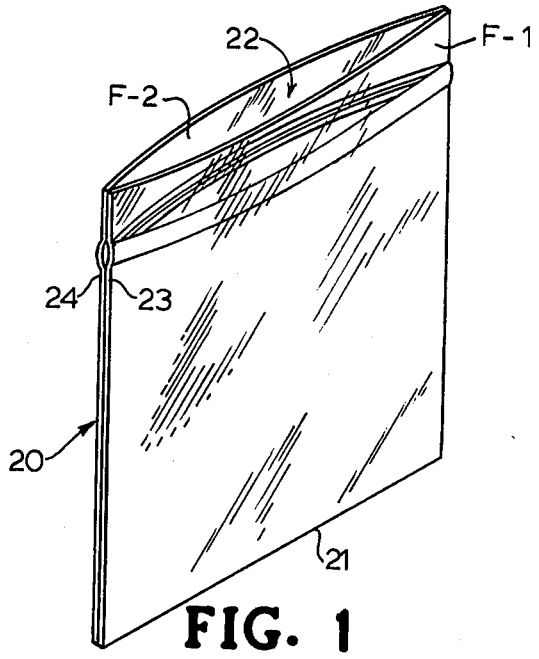
FIG. 1 is a perspective view of a flexible container, i.e., a plastic bag, having a closure arrangement according to the invention.
Figure 2:
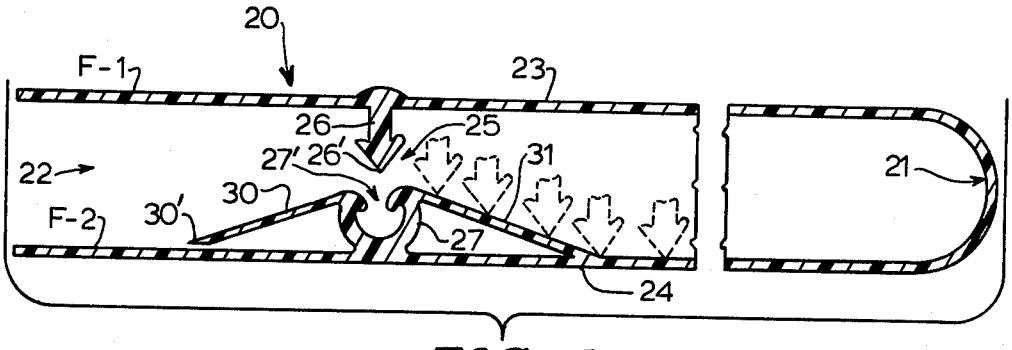
FIG. 2 is a sectional view showing a reclosable plastic bag having sliderless interlocking closure elements and a ramp structure for the female closure element according to a first embodiment of the invention.

Making reference initially to FIGS. 1 and 2, there is schematically illustrated a plastic bag 20 having a closed end 21 and an open end 22 between flanges F1, F2 comprising the outer end portions of the sheet members forming the opposed sides or walls 23, 24 of the bag 20. The legends F-1, F-2 are used in all the drawings to designate the flanges.

Of particular significance to the invention in reference to FIG. 2 is the releasable, flexible fastener structure 25 comprising by way of example and illustration interlocking profiles formed by the continuous rib or male element 26 protruding inwardly from the inner surface of wall 23 and a mating continuous groove or female element 27 projecting inwardly from the inner surface of the wall 24. The arrow-like shape of the male or rib element 26 and hook-shaped groove or female element 27, being used by way of example, may generally follow the construction disclosed in prior art U.S. Pat. No. Re. 28,969 and therefore will not be described in further detail. Of particular significance to the present invention is the inclusion of the ramp surfaces 30, 31 formed so as to provide continuous smooth, planar slide surfaces on both sides of the mouth 27′ of groove element 27. Both surfaces are also inclined with respect to wall 24 when flat. In the FIG. 2 form, ramp surfaces 30, 31 are extruded with the same resilient material employed for forming groove element 27 and are preferably formed as thin ramp walls and are slightly flexible in nature to permit bending.

In use, the bag 20, such as illustrated in FIG. 1 will be filled with the desired contents. The flange portions F1, F2 are then grasped and alignment of a portion of the leading part 26′ of rib element 26 with the mouth 27′ of groove element 27 can be readily effected as illustrated in FIG. 2 simply by engaging the leading part 26′ of rib element 26 with, for example, the ramp surface 31, and sliding rib element 26 through the various positions shown in dashed lines in FIG. 2 until the portion of the leading part 26′ of rib element 26 being guided reaches a position opposite the mouth 27′ of groove element 27 and thus is known to be both in alignment and in position to be readily interlocked by pressing the aligned elements together. After proper alignment and interlocking has been obtained of a portion of the rib or male element with a portion of the groove or female element, continued application of pressure will result in proper engagement of the interlocking elements at that point and thence throughout the length of the interlocking elements as pressure is applied throughout their lengths thereby resulting in the occlusion of the bag.

In the first embodiment of FIG. 2, it will be noticed that ramp 30 is unsecured at its base or outermost edge 30′ where it is proximate the surface of flange F2. This arrangement thus enables ramp 30 to have a limited sliding relation with respect to the flange F-2 so as to provide some flexibility as the rib and groove elements adjust during closing.

Figure 3:
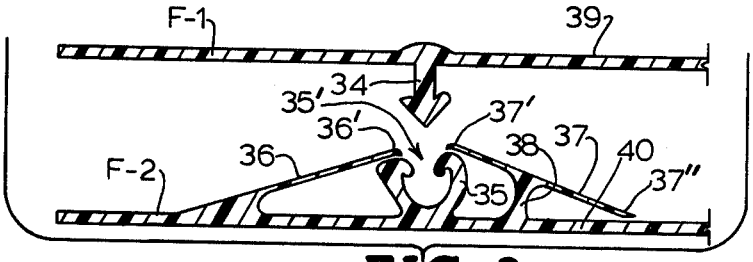
FIG. 3 is a partial sectional view similar to that shown in FIG. 2 illustrating a second embodiment ramp structure for the female closure element.

In another form of ramp construction illustrated as a second embodiment in FIG. 3, the groove element 35, comparable to the hook-shaped groove element 27 of FIG. 2 is associated with rib element 34 on side wall 39 and with molded ramp surfaces 36, 37 intended to serve essentially the same purpose as the previously-described molded ramp surfaces 30, 31. However, it will be noted in FIG. 3 that ramp surfaces 36, 37 are formed so as to be slidably engaged at their respective edges 36′, 37′ with the mouth 35′ of groove element 35 rather than being formed integral with the groove elements as in the first embodiment shown in FIG. 2. FIG. 3 also illustrates ramp surface 36 as being integrally formed with the wall 40 in a cantilever-like construction whereas ramp surface 37 is illustrated as being supported on a molded stem 38. Thus, the respective edge 37′ is free to slide on the mouth of groove element 35 and the respective edge 37″ is free to slide on the inner surface of wall 40. Thus, FIGS. 2 and 3 illustrate the versatility of the invention for adapting to the characteristics of various plastic materials as well as to different thicknesses employed in the bag construction so as to give maximum flexibility to the relative movements of the rib and groove elements in whatever form they might be constructed.

Figure 4:
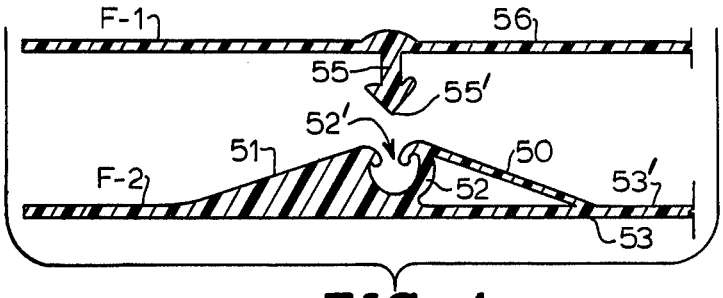
FIG. 4 is a sectional view similar to FIG. 2 illustrating a third embodiment ramp structure for the female closure element.

In a further third embodiment illustrating the versatility of the ramp concept of the invention, there is illustrated in FIG. 4 a ramp construction in which one ramp 50 is formed in sheet-like form in the manner of ramp 31 previously illustrated and described in reference to FIG. 2 whereas the other ramp 51 is illustrated as being molded as an integral structure contiguous with and forming one side of the groove element 52. As with the first and second embodiments previously described in reference to FIGS. 2 and 3, the groove element and ramp construction illustrated in FIG. 4 protrudes inwardly from the inner surface 53' of the bag sidewall sheet 53. As with the prior embodiments, it can also be seen that the leading part 55' of rib element 55 on side wall 56 can be readily slid into position on either ramp 51 or ramp 50 and be quickly aligned with the mouth 52' of groove element 52 for interlocking in the normal manner.

Figure 5:
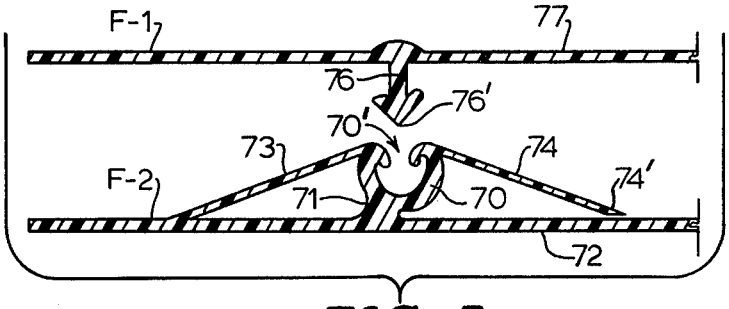
FIG. 5 is a sectional view similar to FIG. 2 illustrating a fourth alternate ramp structure for the female closure element.

In FIG. 5, the groove element 70 is shown molded with a supporting base stem 71 formed integral with and protruding inwardly from the side wall 72. In this fourth embodiment, the ramp surface 73 will be seen as being joined between the mouth 70' of groove element 70 and the side wall 72 whereas the ramp 74 is illustrated as being joined to an opposite side of the mouth of groove element 70 but having its base or outermost edge 74' in a sliding relation on the inner surface of wall 72 thus allowing some bending of groove element 70 on its stem 71 to take place as may be required during interlocking and disengagement. Otherwise, it can be seen that the leading part 76' of rib element 76 on side wall 77 can slide into position along either ramp 73 or 74 as previously described to facilitate the aligning and interlocking operation.

Figure 6:
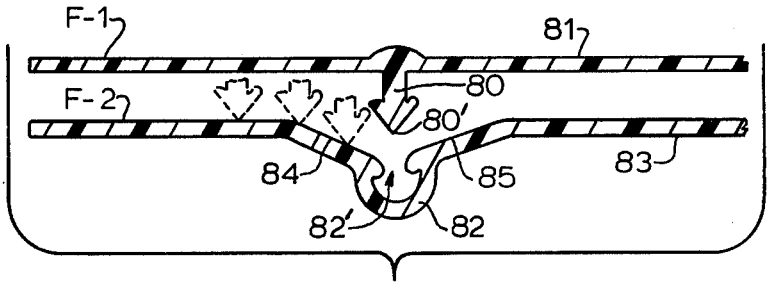
FIG. 6 is a sectional view similar to FIG. 2 illustrating a fifth embodiment ramp structure for the female closure element.

FIG. 6 illustrates a fifth embodiment in which the rib element 80 protrudes inwardly from the side wall 81 whereas the groove element 82 protrudes outwardly with relation to the opposing side wall 83 when flat as illustrated and is operatively associated with the interior ramp surfaces 84, 85. Ramp surfaces 84, 85, as with the other ramp surfaces previously described, provide resilient, smooth, inclined slide surfaces formed of the same material of which groove element 82 is formed. It will be noted in this fifth embodiment that the leading part 80' of rib element 80 when pressed against wall 85 can be easily guided toward the mouth 82' of groove element 82 during the aligning operation as illustrated in FIG. 6. Thus, again there is illustrated the versatility of the invention to a variety of forms of mating male-female closure profile constructions.

Figure 7:
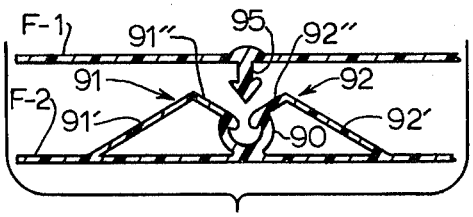
FIG. 7 is a sectional view illustrating a sixth embodiment ramp structure for the female closure element.

FIG. 7 illustrates a sixth embodiment in which the groove element 90 is associated with ramp surfaces 91, 92. Ramp surface 91 is characterized by having an outwardly sloping surface 91' formed integral with an inwardly sloping surface 91''. Similarly, ramp surface 92 has a outwardly sloping surface 92' and an inwardly sloping surface 92''. Thus, rib element 95 can effectively "sense" the correct location when a change of ramp direction is felt.

Figure 8:
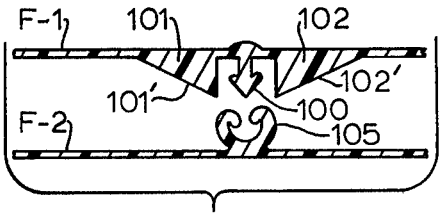
FIG. 8 is a sectional view illustrating a seventh embodiment ramp structure for the male closure element.

FIG. 8 illustrates in a seventh embodiment how the male rib element 100 can also be provided with the illustrated ramps 101, 102. Thus, in this embodiment, the groove element 105 can be made to slide on either of the male element ramp surfaces 101', 102' during the aligning operation.

In all of the described ramp constructions it will be noticed that the ramps provide noticeable assistance in the aligning process but in no instance is there any interference with the normal locking sequence once the starting portions of the male element and female element have become aligned which enables the remaining portions to follow the same alignment. Thus, in summary, it can be seen that the invention provides a substantially improved means for aligning the closure profiles and thus eliminates the hit-miss method customarily associated with prior art releasable fastener constructions.

What is claimed is:

1. In a reclosable, flexible container of the type comprising:

(a) a plastic film bag having flexible first and second opposing walls and an opening therein;

(b) interlocking and cooperative male and female elements formed of a resilient material integrally at the inner surface of said walls about the opening of said bag, said male element being formed at said first wall and having locking surfaces thereon and said female element being formed at said second wall and having locking surfaces leading from an outer mouth portion thereof for engaging said male element locking surfaces and closing said bag thereby; and (c) external flanges formed on the upper exposed edges of said walls and extending outwardly of said elements and adapted to be gripped and drawn apart to separate said elements with said bag being opened by drawing said elements apart and being closed by pressing said elements together;

the improvement comprising:

(d) first and second ramp structures formed integrally with said second wall of said bag adjacent said female element, said ramp structures extending laterally from opposite sides of the outer mouth portion of said female element to the inner surface of said second wall and providing planar surfaces on both sides of said female element upon which the leading part of said male element can slide towards and so as to locate at least a portion thereof over a portion of the mouth of said female element to be interlocked therewith enabling subsequent interlocking of the remaining portions of said elements by continuous pressure applied thereto to close said bag.

2. In a reclosable container as claimed in claim 1 wherein said male element comprises a rib element formed of the same material of which said first wall is made and said female element comprises a groove element with hook members and is formed of the same material of which said second wall is made.

3. In a reclosable container as claimed in claim 2 wherein said rib and groove elements protrude inwardly from the respective first and second wall inner surfaces.

4. In a reclosable container as claimed in claim 2 wherein said rib element protrudes inwardly from the said first wall inner surface and said groove element protrudes outwardly from the said second wall inner surface.

5. In a reclosable container as claimed in claim 2 wherein in at least one of said ramp structures the innermost or outermost edge of the surface thereof is unsecured.

6. In a reclosable container as claimed in claim 2 wherein the outermost edges of both surfaces of said ramp structures are integrally formed with the inner surface of said second wall and the innermost edges of both surfaces of said ramp structures are integrally formed with the mouth portion of said groove element.

7. In a reclosable container as claimed in claim 2 wherein at least one of said ramp structures is supported on a stem and the innermost and outermost edges of the surface thereof are unsecured to the material forming said second wall and groove element.

8. In a reclosable container as claimed in claim 7 wherein the innermost edge of the other of said ramp structures not supported on a stem has its innermost edge residing proximate to but unsecured to the mouth portion of said groove element.

9. In a reclosable container as claimed in claim 2 wherein at least one of said ramp structures is formed of solid said resilient material establishing both said one ramp structure and one side of said groove element.

10. In a reclosable container as claimed in claim 2 wherein said groove element is formed integrally with a supporting stem formation.

11. A container comprising two flexible sidewalls and an interlocking closure device formed of resilient plastic material and including male and female closure profiles operable for being interlocked continuously over a predetermined length and connected to said sidewalls, external flanges formed on the upper exposed edges of said sidewalls and extending outwardly of said profiles and adapted to be gripped and drawn apart to separate said profiles with said bag being opened by drawing said profiles apart and being closed by pressing said profiles together wherein the improvement comprises providing structures with planar surfaces on both sides and along the length of a selected one of said closure profiles and being formed and located so as to facilitate the alignment and interlocking of said profiles by allowing at least a portion of the profile opposite said selected profile to slide from an unaligned position across one of such structures towards said selected profile to be seated into a position of proper alignment from which position of proper alignment application of continued pressure will result in proper engagement of the interlocking profiles at such position and thence throughout the length of the interlocking profiles as pressure is applied throughout their lengths thereby resulting in the occlusion of the bag.

12. A container as claimed in claim 11 wherein said closure profiles and structures are formed of the same resilient plastic material of which said sidewalls are formed.

13. A container as claimed in claim 11 wherein said selected profile is the female profile.

14. A container as claimed in claim 11 wherein said selected profile is the male profile.

15. A container as claimed in claim 12 wherein said selected profile is the female profile.

16. A container as claimed in claim 12 wherein said selected profile is the male profile.

* * * * *